US005904401A

United States Patent [19]

Alberda et al.

[11] Patent Number: 5,904,401

[45] Date of Patent: May 18, 1999

[54] RECLINER CHAIR

[75] Inventors: Joel D. Alberda, Leo; Donald E. Newfer, Auburn, both of Ind.

[73] Assignee: R.M. Wieland Company, Inc., Grabill, Ind.

[21] Appl. No.: 08/905,975

[22] Filed: Aug. 4, 1997

[51] Int. Cl.[6] ..... B60N 2/02

[52] U.S. Cl. ..... 297/354.13; 297/65; 297/85; 5/41; 5/37.1; 5/31

[58] Field of Search ..... 297/354.13, 65, 297/300.1, 341, 362.11, 362.14, 64, 85; 5/41, 42, 37.1, 13, 31

[56] References Cited

U.S. PATENT DOCUMENTS

| | | | |
|---|---|---|---|
| 1,634,551 | 7/1927 | Moore . | |
| 2,164,438 | 7/1939 | Woller | 5/21 |
| 2,328,411 | 8/1943 | Bergstrom | 5/48 |
| 2,712,655 | 7/1955 | Hatton | 5/21 |
| 3,164,849 | 1/1965 | Poskin | 5/41 |
| 4,186,960 | 2/1980 | Mizelle | 297/65 X |
| 4,563,037 | 1/1986 | Tiffany | 297/105 |
| 5,153,951 | 10/1992 | Hester | 5/37.1 |
| 5,195,194 | 3/1993 | Bradley et al. | 5/37.1 |
| 5,788,329 | 8/1998 | Pilarczyk et al. | 5/41 X |

OTHER PUBLICATIONS

Brandrud Slumber, Brandrud Furniture, Inc., Auburn, Washington catalog.
Thonet Models 3801 and KR10C/F.
Nemschoff SleepOver, Nemschoff Healthcare Furniture Specialists, Sheboygan, WI catalog.
Tiffany Chair/Sleeper.
Softcare Healthcare Furnishings Sleeper Chair.

*Primary Examiner*—Laurie K. Cranmer
*Attorney, Agent, or Firm*—Baker & Daniels

[57] ABSTRACT

A recliner chair which converts from a chair configuration to a bed configuration in a single motion. The chair includes a frame, a seat, a back, an intermediate member and a linkage which provides the conversion from chair configuration to bed configuration upon forward movement of the seat relative to the frame. The linkage is comprised of two crossed links, each pivotally attached to the frame, one of which is slideably connected to the underside of the seat, the other of which is pivotally attached to the intermediate member. The links are interconnected by a bushing which is slideably attached to one link and rotatably attached to the other link.

22 Claims, 6 Drawing Sheets

RECLINER CHAIR

BACKGROUND OF THE INVENTION

1. Field of Invention

The invention relates generally to reclining chairs and, more particularly, to chairs which recline to assume a bed configuration.

2. Background Art

Recliner chairs are chairs which provide for lowering the back-supporting surface thereof from a somewhat vertical position to a somewhat horizontal position, allowing the user to lie rather than sit. Generally, such chairs provide a foot rest to support the legs of the user while the back of the chair is reclined.

A form of recliner chair provides a substantially horizontal sleeping surface when reclined. Previous chairs of this type are exemplified in U.S. Pat. Nos. 1,634,551 (Moore); 2,164,438 (Woller); 2,328,411 (Bergstrom); 2,712,655 (Hatton); and 4,563,037 (Tiffany). These and other chair-beds such as the Brandrud Slumber™, Thonet Models 3801 and KR10C/F, and the Nemschoff SleepOver™ require multiple motions or steps to accomplish the conversion from chair to bed.

Convertible chair beds are often used for temporary accommodations in public facilities such as hospitals by people who may lack the mechanical aptitude or experience to convert previous chair-beds from a chair to a bed or who cannot, or prefer not, to perform multiple motions or steps to achieve the conversion. A recliner chair which converts easily to a bed configuration in a single motion is greatly desired.

SUMMARY OF THE INVENTION

The present invention provides a recliner chair which easily converts from a chair to a bed in a single motion. Through use of an inventive linkage, a forwardly directed pull on the seat portion of the chair, which is supported by wheels which roll on the floor, extends the seat forward to support the bed user's legs, raises an intermediate member which is disposed beneath the seat while in the chair configuration to a position substantially coplanar and adjacent the seat to support the user's hips and lower back, and pivotally reclines the back to a position substantially coplanar and adjacent the intermediate member to support the user's upper back, shoulders and head. A lock may be provided to automatically lock the chair-bed in its bed configuration.

The inventive linkage interconnects the chair frame, seat, intermediate member and back and comprises first and second elongated links pivotally mounted to the frame. The first link has one end slideably connected to the seat, and the second link having one end connected to the intermediate member; the other end of each link is pivotally attached to the frame. The links are interconnected via a bushing rotatably connected to one of the links and slideably connected to the other link.

The present invention is advantageous because the user need only pull forward on the seat to convert the chair into its locked bed configuration. No further movements or steps are required, thus easily accommodating the needs of users who may lack mechanical aptitude or experience in converting chair-beds, or who are averse to performing multiple conversion motions or steps. The bed may be easily converted back to a chair by simply releasing the lock, briskly pulling the back to an upright position and rearwardly pushing the seat of the chair to its original position.

A further advantage of the present invention is that the rear of the chair need be spaced only a small distance from a wall. The seat back pivots about a transverse axis located near its center, thus only a portion of the seat back swings from its somewhat vertical to its horizontal position, reducing the space required vis-a-vis some previous chair-bed designs. Furthermore, the frame of the inventive recliner chair may include wheels or casters to facilitate easy relocation of the chair.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
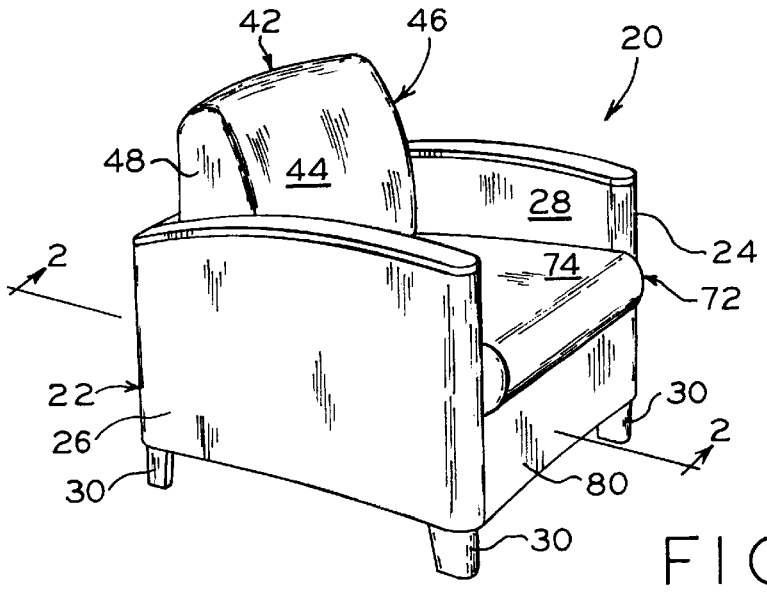
FIG. 1 is a perspective view of one embodiment of the recliner chair of the present invention, shown in its chair configuration.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in alternative forms, and such exemplifications are not to be construed as limiting the scope of the invention in any manner.

DETAILED DESCRIPTION OF THE INVENTION

The embodiments disclosed below are not intended to be exhaustive or limit the invention to the precise forms disclosed in the following detailed description. Rather, the embodiments are chosen and described so that others skilled in the art may utilize its teachings. It should be noted for descriptive clarity that the recliner chair of the present invention extends itself or reclines in a fore-aft direction termed "longitudinal" and that the below-described pivoting or rotating components do so about axes extending in a "transverse" direction.

Figure 2:
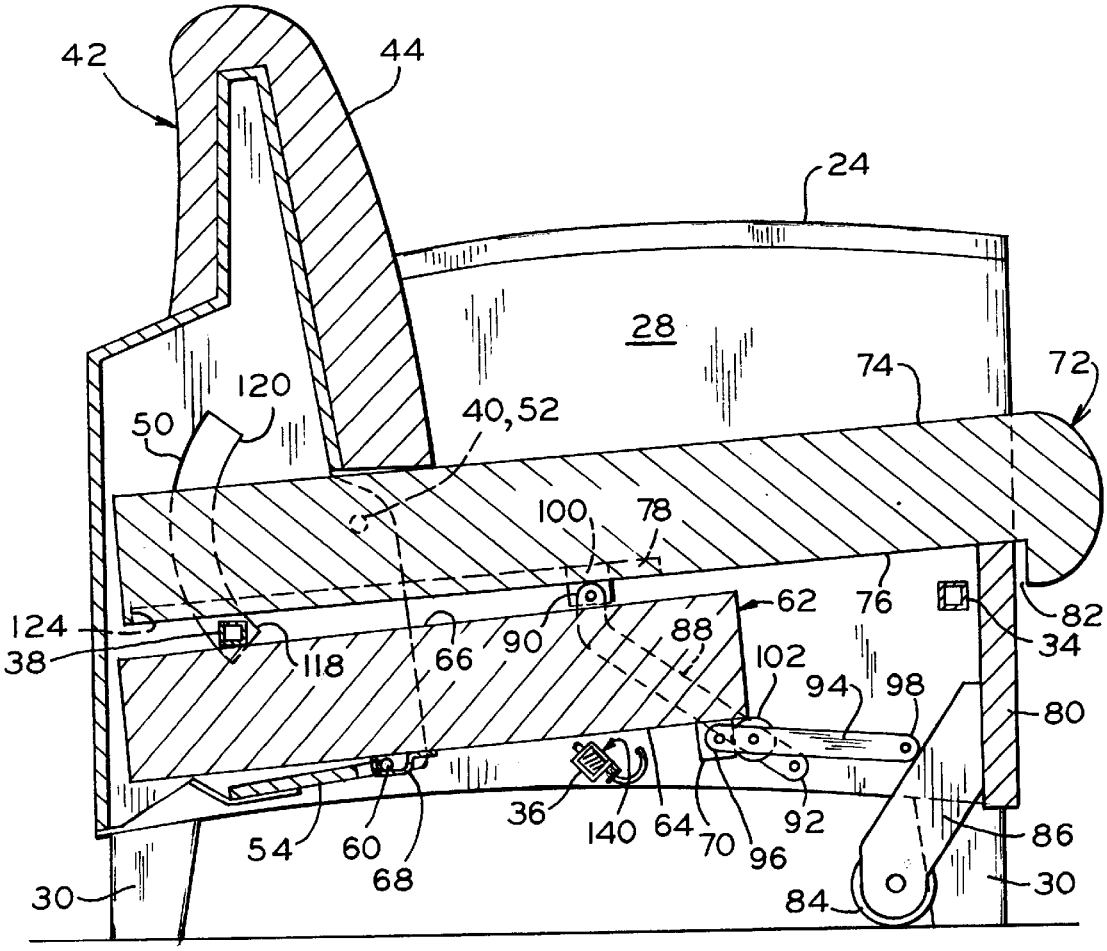
FIG. 2 is a sectional side view of the recliner chair of FIG. 1, taken along a vertical plane through the line 2—2 of FIG. 1.

Referring now to the drawings and particularly to FIGS. 1 and 2, recliner chair 20 generally comprises frame 22, back 42, seat 72 and intermediate member 62 normally disposed beneath the seat (FIG. 2); these four (4) components may be made of wood and upholstered with a suitable fabric. Back 42, intermediate member 62 and seat 72 each have cushioned surfaces 44, 66 and 74, respectively, which form the mattress of chair 20 when in its bed configuration. Frame 22 has left hand and right hand side members 24 and 26, respectively (FIG. 1), which are substantially vertically planar. Each frame side member 24, 26 has an inside surface 28. Feet 30 or, alternatively, wheels or casters (not shown) support the frame on the floor. Elongate, transverse braces 34, 36, 38 disposed near the front, center and rear of the chair, respectively (FIG. 2), attach to each side member 24, 26 and extend normally from each inside surface 28. Some or all of braces 34, 36, 38 may be made of steel, and may be hollow and of substantially square cross section. While the recliner chair is in its chair configuration, as shown in FIG. 2, front-most brace 34 is disposed below seat 72, centermost brace 36 is disposed below intermediate member 62 and rearmost brace 38, which may be square or round in cross section, is disposed below seat 72 and above intermediate member 62. Each inside frame surface 28 is provided with pivot point 40 forwardly and upwardly disposed relative to brace 38, which may be recessed into surface 28 or, alternatively, extending a short distance therefrom.

Chair back 42 comprises cushioned surface 44, left hand and right hand surfaces 46, 48, respectively (FIG. 1) and bottom panel 54 (FIG. 2). Side surfaces 46, 48 of back 42 are substantially planar and parallel to inside surfaces 28 of frame side members 24, 26, respectively. Surfaces 46 and 48 each have pivot point 52, which is associated with and superimposed upon pivot point 40 of each inside frame surface 28. Each pivot point 52 cooperatively extends into or, alternatively, receives corresponding pivot point 40, as the case may be, providing a rotatable joint between frame 22 and back 42. Each side surface 46, 48 of back 42 is provided with arcuate slot 50 having a first end 118 and a second end 120. Slots 50 are located at a fixed radius about pivot points 52 and slideably receive rearmost frame brace 38. As chair 20 is converted from its chair configuration to its bed configuration, slots 50 travel upon brace 38 from their first ends 118 to their second ends 120.

Figure 7:
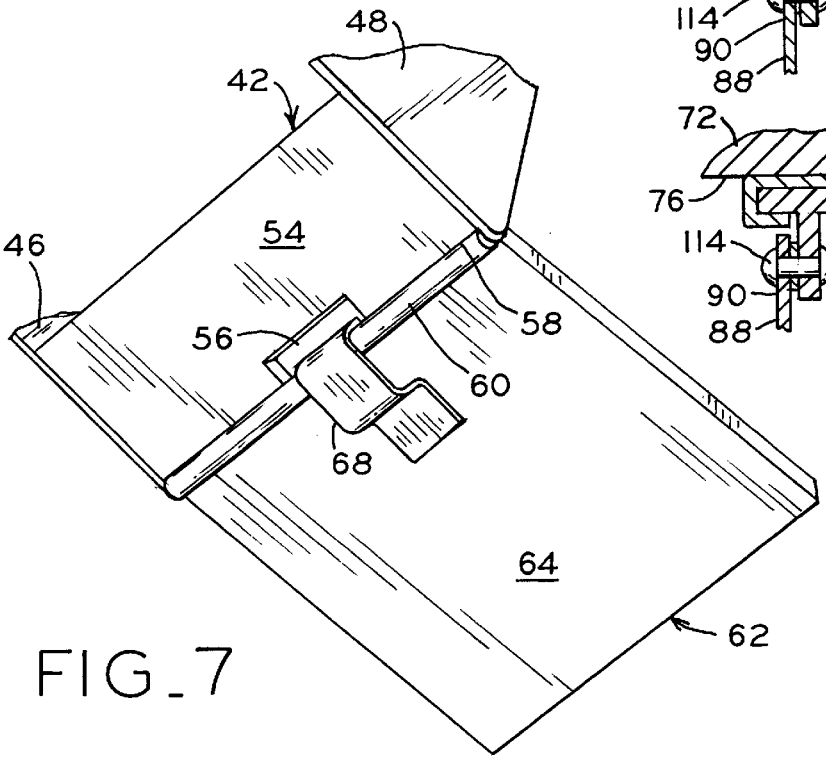
FIG. 7 is a fragmentary isometric view showing the interconnection between the chair back and intermediate member of the present invention.

Intermediate member 62 is substantially planar and has lower surface 64 and cushioned upper surface 66. While chair 20 is in its chair configuration, member 62 is disposed above centermost frame brace 36 and below rearmost frame brace 38 (FIG. 2). While chair 20 is in its bed configuration, cushioned surface 66 of member 62 is disposed between cushioned surface 44 of back 42 and cushioned surface 74 of seat 72 (FIG. 5), as will be further discussed below. Attached to lower surface 64 of member 62, near its longitudinal center, is bracket 68 adapted to pivotally and slidably receive transverse rod 60, which is securely attached to edge 58 of bottom panel 54 of chair back 42 (FIG. 7). Panel 54 is provided with bracket receiving notch 56 to accommodate sliding movement of bracket 68 relative to rod 60. The purpose of the joint between bracket 68 and rod 60 is to provide pivoting engagement of member 62 and back 42; the accommodation of sliding movement within this joint should not be construed as limiting the scope of the invention, for it is envisioned that such pivoting engagement can be accomplished without rod 60 sliding within bracket 68. Further, it should be noted that providing rod 60 upon edge 58 is but one method of providing a pivot point, and the scope of the invention should not be so limited. Rather, any suitable method of pivotally engaging seat back 42 to the approximate longitudinal center of member 62 is to be considered within the scope of this invention.

Seat 72 comprises a substantially planar member having cushioned upper surface 74 and lower surface 76. While recliner chair 20 is in its chair configuration (FIG. 2), the rearmost portion of seat 72 is housed within chair back 42, extending therein adjacent and below cushioned surface 44 thereof, and disposed above frame brace 38. The forwardly disposed portion of lower seat surface 76 has transversely attached panel 80. Wheels 84 rotatably disposed on brackets 86 may be provided on the rear face of panel 80 to support the forward portion of seat 72 and provide a means of easily moving the seat longitudinally. Pull handle 82 is provided at the lower, front-most portion of seat 72 for forwardly moving the seat for conversion of recliner chair 20 from its chair to its bed configuration.

Figure 6A:
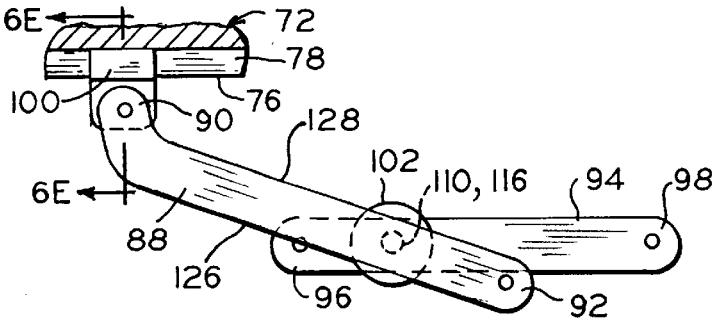
FIG. 6A is a fragmentary sectional side view of the interconnected linkage of the present invention oriented as in FIGS. 2 and 3.
Figure 6C:
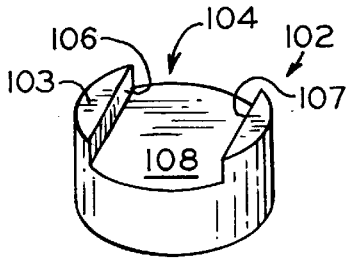
FIG. 6C is a perspective view showing one side of one embodiment of the interconnecting bushing of the interconnected linkage of the present invention.
Figure 6B:
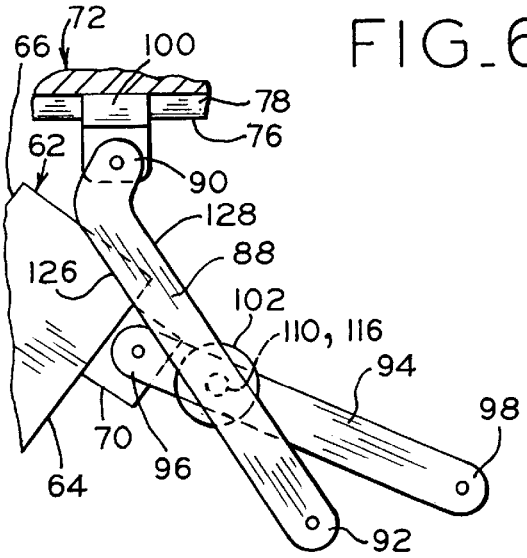
FIG. 6B is a fragmentary sectional side view of the interconnected linkage of the present invention in the position shown in FIG. 4.
Figure 6D:
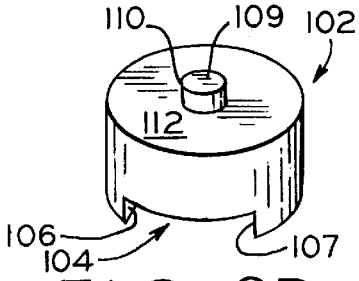
FIG. 6D is a perspective view showing the opposite side of the bushing shown in FIG. 6C.
Figure 6E:
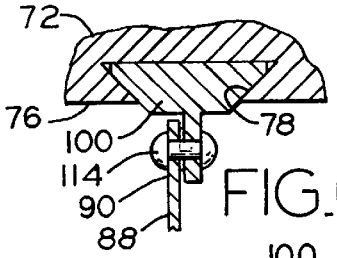
FIG. 6E is a fragmentary sectional view along line 6E—6E of FIG. 6A.
Figure 6F:
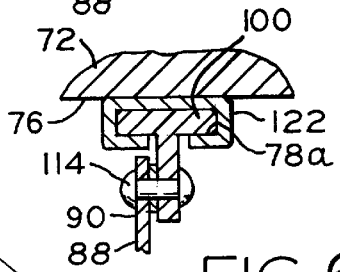
FIG. 6F is a fragmentary sectional view along line 6E—6E of FIG. 6A, showing an alternative embodiment to that shown in FIG. 6E.

Lower surface 76 of seat 72 has longitudinal slots 78 which may be formed in surface 76 as shown in FIG. 6E or, alternatively, longitudinal slots 78*a* may be provided by attaching longitudinal runners 122 to surface 76 as shown in FIG. 6F. Each slot 78 has stop 124 disposed at its rearmost end which may be formed integrally within surface 76 or, alternatively, each attached runner 122, or may be a component part attached or fitted thereto. Follower 100 slides longitudinally in each slot 78 from its front-most end of travel, a position corresponding to the chair configuration of recliner chair 20, to its rearmost end of travel where stop 124 will abut follower 100 and prevent further travel along slot 78.

The linkage of the present invention comprises a first and second link, 88 and 94, respectively, each of which may be substantially flat steel stampings. First link 88 is somewhat hockey stick shaped, having first end 90 disposed at the end of the shorter leg and second end 92 disposed at the end of the longer leg, the longer leg having flat, parallel edges 126 (FIGS. 6A, 6B). First end 90 is pivotally attached to follower 100 as by rivet 114 (FIGS. 6E, 6F) and second end 92 is pivotally attached to inside frame surface 28, with link 88 oriented such that its shorter leg is somewhat vertical when recliner chair 20 is in its chair configuration and somewhat horizontal when chair 20 is in its bed configuration.

Second link 94 is substantially straight, having first end 96 and second end 98. First end 96 is pivotally attached to bearing 70, disposed on the front-most portion of lower surface 64 of intermediate member 62 (FIG. 6B), and second end 98 is pivotally attached to inside frame surface 28 forward of the point second end 92 of first link 88 attaches to surface 28 and such that second link 94 is somewhat horizontal when recliner chair 20 is in its chair configuration and substantially vertical when chair 20 is in its bed configuration. Thus, when viewed from the side, links 88 and 94 are crossed one over the other in all final and intermediate chair-bed configurations. One or both second ends 92, 98 of links 88, 94, respectively, may be offset from and parallel to the main body of each respective link or otherwise adapted, as through the use of spacers (not shown) between the face the link and frame surface 28 at their attaching point, to maintain a substantially parallel and spaced relationship between links 88, 94 and surface 28, preventing the links from slideably engaging one another and surface 28.

Links 88 and 94 are interconnected through bushing 102 disposed therebetween (FIGS. 6A, 6B) which, in one embodiment, may have a somewhat cylindrical shape and may be made from a self-lubricating material such as nylon. In this embodiment, axial face 103 of bushing 102 has recessed portion 104 extending completely thereacross providing parallel planar sides 106, 107 and recessed planar surface 108 (FIG. 6C). Sides 106 and 107 are spaced from each other a distance very nearly, but not less than, the distance between edges 126 and 128 of link 88. Extending between and perpendicular to sides 106, 107, surface 108 is located at a depth from axial face 103 at least as great as the material thickness of link 88. Axial face 109 of bushing 102, located opposite axial face 103 is cut away to provide integral cylindrical pin 110 and annular bearing surface 112 (FIG. 6D). Bearing surface 112 is substantially parallel surface 108 and is located at a depth from axial face 109 at least as great as the material thickness of link 94. Hole 116, located in link 94 between ends 96 and 98, rotatably receives pin 110, slideably engaging bearing surface 112 and the face of link 94. Recessed portion 104 receives link 88 between sides 106 and 107, with recessed surface 108 slidably engaging the face of link 88.

Figure 6G:
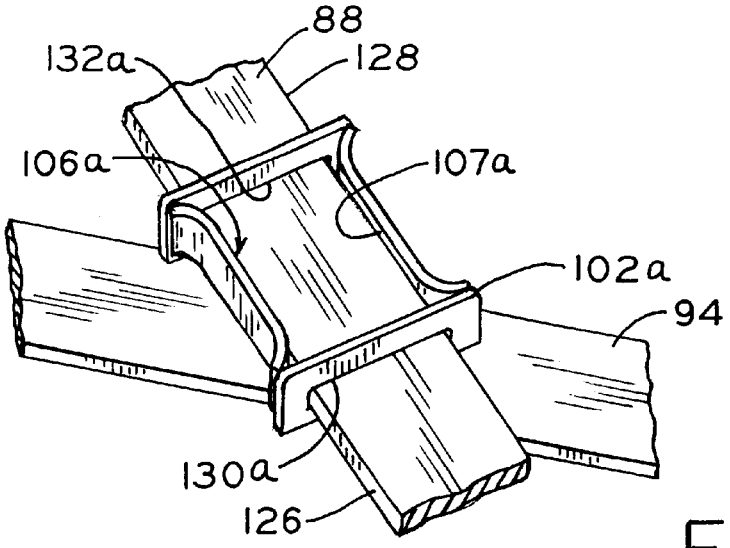
FIG. 6G is an isometric view of an alternative interconnecting bushing to that shown in FIGS. 6C–6D, shown with fragments of the interconnected links.
Figure 6H:
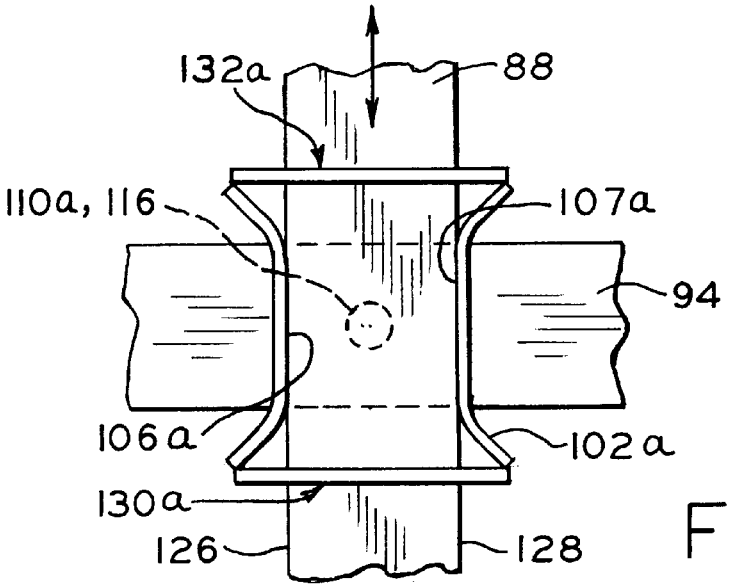
FIG. 6H is a side view of the bushing of FIG. 6G, shown with fragments of the interconnected links.
Figure 6I:
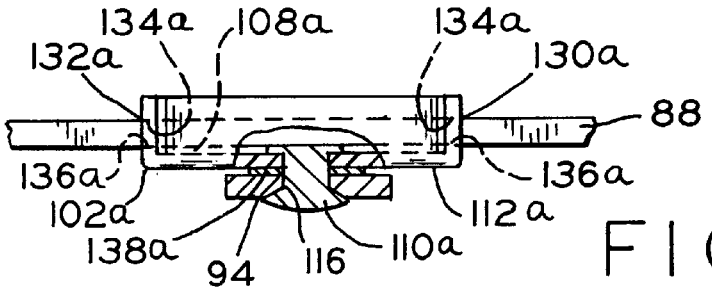
FIG. 6I is an elevation of the bushing of FIG. 6G, shown with fragments of the interconnected links.

The above-described embodiment of bushing 102 should not be construed as limiting the scope of the invention, which contemplates other alternative bushing embodiments which may be made from other materials, as shown in FIGS. 6G–6I, for example. In this embodiment, stamped steel bushing 102*a*, which may be coated with a lubricant, has a substantially rectangular shape and is adapted to provide ends having slots 130*a*, 132*a* through which link 88 slideably extends. Each slot 130*a*, 132*a* has upper and lower edges, 134*a* and 136*a*, respectively, which slideably engage the faces of link 88, which is maintained in a parallel, spaced relationship with link 94. Bushing 102*a* may also be adapted to provide walls 106*a* and 107*a*, which slideably engage edges 126 and 128 of link 88, respectively. Referring to FIG. 6I, rivet 110*a* extends through a hole in recessed surface 108*a* of bushing 102*a* and hole 116 in link 94, rotatably attaching them. Washer 138*a* may be disposed about rivet 110*a* intermediate bushing 102*a* and link 94 to prevent direct sliding engagement therebetween.

Figure 4:
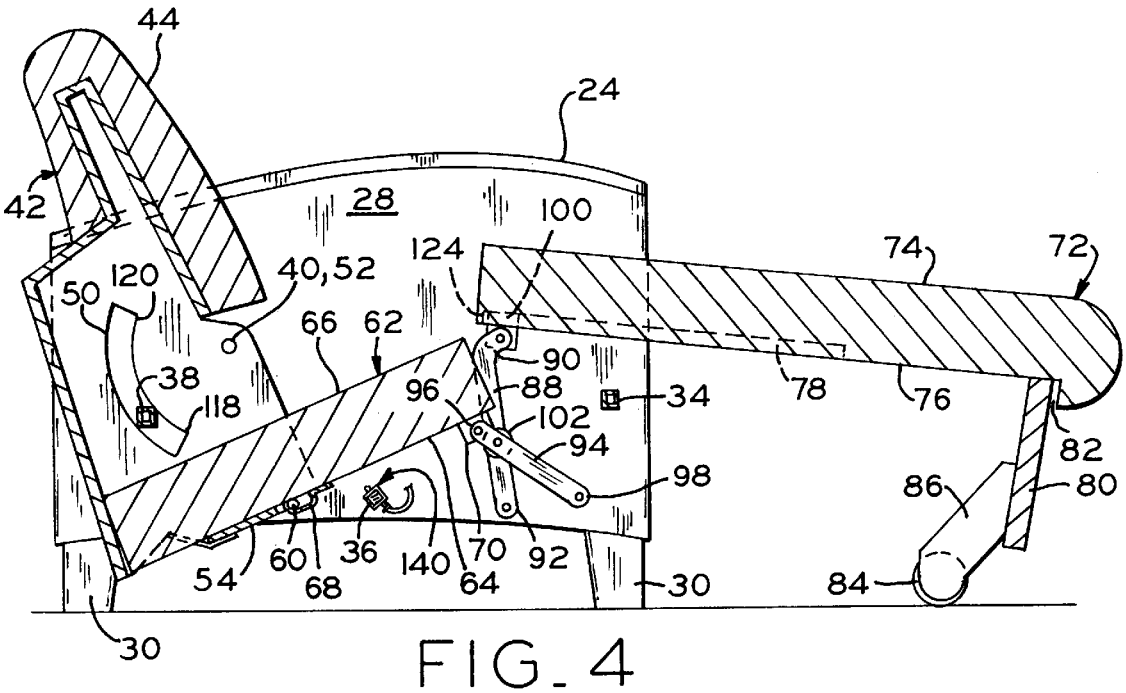
FIG. 4 is a sectional side view of the recliner chair of FIG. 1, taken along a vertical plane through the line 2—2 of FIG. 1, shown in a second intermediate position between chair and bed configurations.
Figure 5:
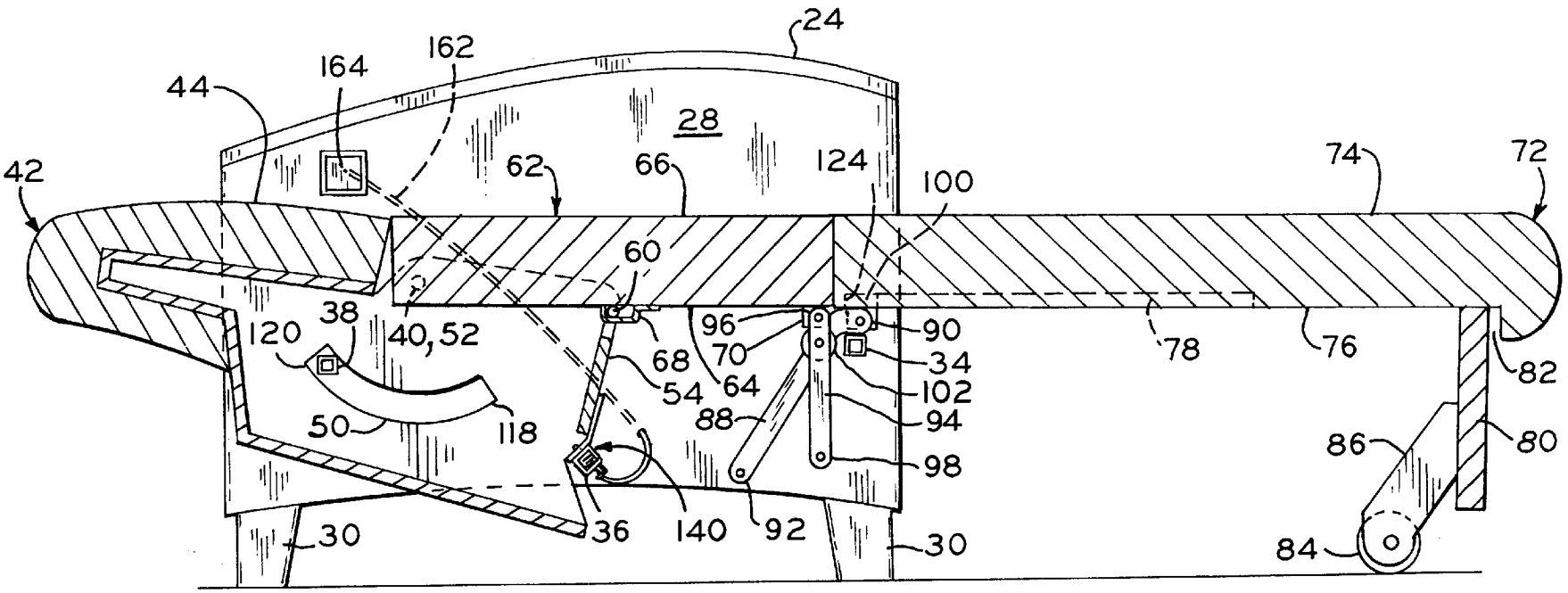
FIG. 5 is a sectional side view of the recliner chair of FIG. 1, taken along a vertical plane through the line 2—2 of FIG. 1, shown in its bed configuration.
Figure 8:
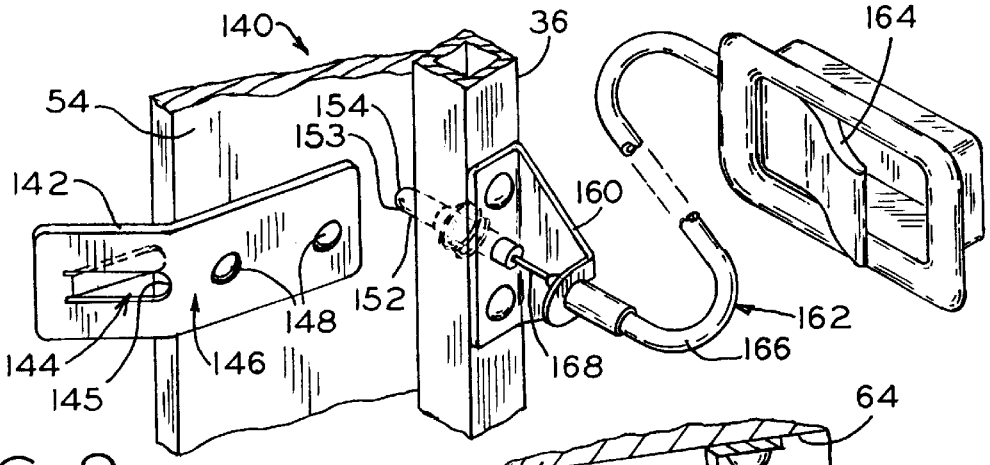
FIG. 8 is a fragmentary perspective view of the lock of the present invention.
Figure 9:
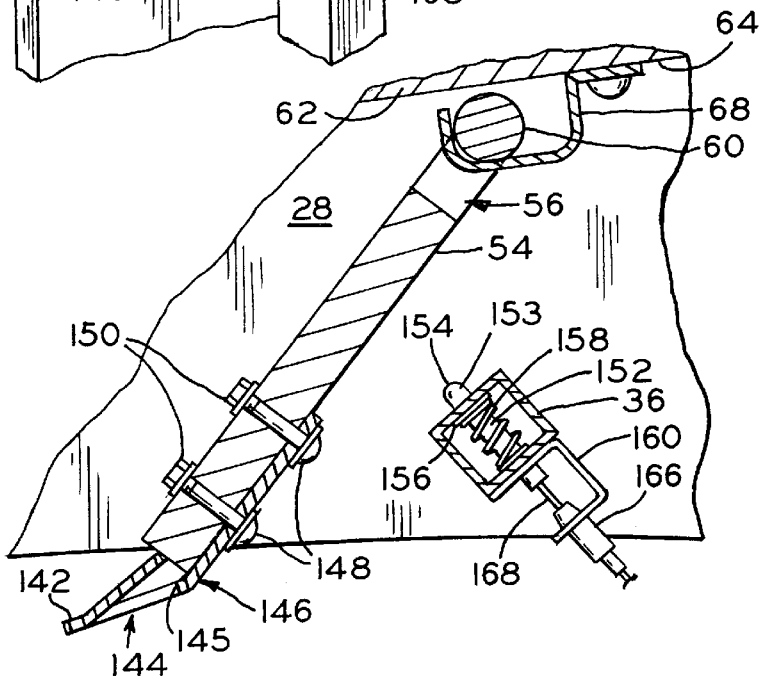
FIG. 9 is a fragmentary sectional view of the lock mechanism of FIG. 8 along line 2—2 of FIG. 1, shown in an unlocked position.
Figure 10:
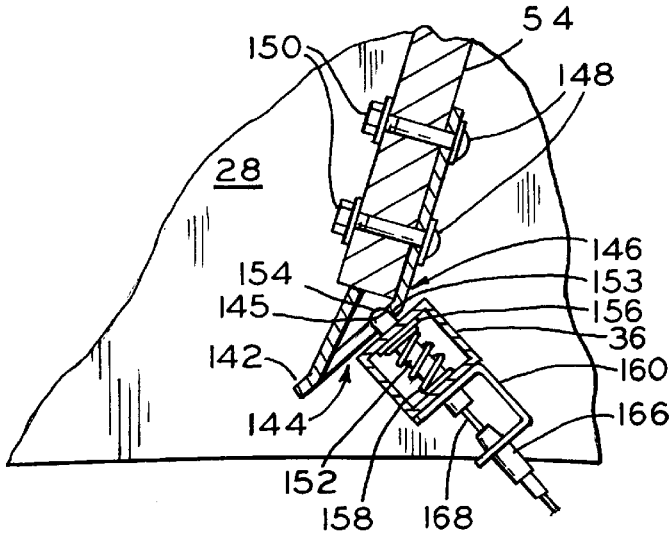
FIG. 10 is a fragmentary sectional view of the lock mechanism of FIG. 8 along line 2—2 of FIG. 1, shown in its locked position.

Recliner chair 20 may be provided with lock 140 to maintain its bed configuration, shown in FIG. 5. Referring to FIGS. 8–10, lock 140 is automatically engaged during the conversion of chair 20 from its chair configuration to it bed configuration and comprises stamped lock plate 142 and spring loaded lock pin 152, which extends through brace 36 as shown in FIGS. 9–10. As best seen in FIG. 9, plate 142 is somewhat L shaped, having an oblique angle between its two (2) legs, and is fastened to bottom panel 54 of back 42, preferably near its transverse center, by means such as screws 148 and nuts 150 such that the angle formed in plate 142 is disposed at the rearmost edge of panel 54. Plate 142 may be made of steel and has recess 144 located in the leg of plate 142 overhanging the rearmost edge of panel 54. Recess 144 is adapted to receive pin 152 and has side 145 formed of the material thickness of the plate and adjacent striking surface 146. Lock pin 152 has cylindrical outer surface 153 and somewhat hemispherical tip 154, and is slideably disposed within frame brace 36, as shown in FIGS. 2–5 and 8–10. Disposed between opposing cross sectional sides of brace 36 and about pin 152 is compression spring 158 which abuts thrust washer 156 affixed to outer pin surface 153, urging pin tip 154 outward from brace 36 such that as chair 20 approaches its bed configuration, i.e., as back 42 continues its counterclockwise rotation about pivot points 40, 52 (FIG. 5), tip 154 strikes striking surface 146 of plate 142, sliding thereon towards recess 144. Pin 152 is depressed into brace 36 against the force of spring 158 as tip 154 continues sliding upon striking surface 146 until chair 20 reaches its bed configuration. At this point, pin tip 154 is disposed over recess 144 and is urged therein by spring 158, placing pin outer surface 153 into bearing engagement with recess side 145 (FIG. 10), thus preventing clockwise motion of back 42 about pivot points 40, 52 and locking chair 20 into its bed configuration. Further counterclockwise motion of back 42 about pivot points 40, 52 is prevented by brace 38 abutting end 120 of slot 50.

As shown, lock release lever 164 is disposed within frame inner surface 28 (FIG. 5) such as to be hidden by left hand side 46 of back 42 when chair 20 is in its chair configuration. Lever 164 becomes exposed as back 42 rotates counterclockwise and chair 20 assumes it bed configuration, as seen in FIG. 5. Bowden cable 162 interconnects lever 164 and lock pin 152. Bracket 160 attached to brace 36 retains the end of Bowden cable jacket 166 an appropriate distance from brace 36 to allow Bowden cable wire 168, attached to the end of pin 152 opposite tip 154, to retract pin 152 into brace 36 against the force of spring 158, thus taking pin outer surface 153 out of bearing engagement with recess side 145, releasing lock 140.

Figure 3:
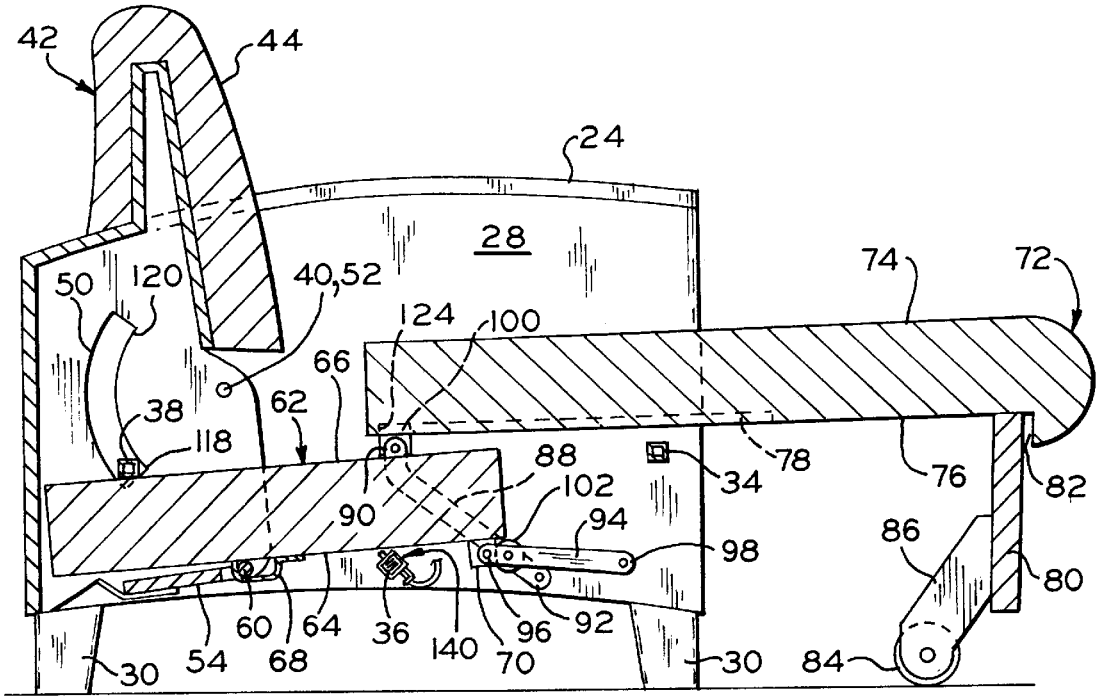
FIG. 3 is a sectional side view of the recliner chair of FIG. 1, taken along a vertical plane through the line 2—2 of FIG. 1, shown in a first intermediate position between chair and bed configurations.

The operation of the recliner chair will be readily apparent from the following description and referring to FIGS. 2–5 in succession: Assuming the chair is in its chair configuration as shown in FIGS. 1 and 2, a forward pulling motion on handle 82 causes seat 72 to roll forward wheels 84 and follower 100 to slide in slot 78 from its front-most end of travel rearward. Referring now to FIG. 3, as follower 100 reaches the rearmost end of travel in slot 78, abutting stop 124, first link 88 begins to rotate forward (clockwise in FIG. 3) about its second end 92, which is pivotally attached to frame inside surface 28. Note that first end 90 of first link 88 pivots relative to follower 100 about rivet 114 (FIGS. 6E, 6F). Referring now to FIG. 4, continued forward motion of seat 72 and forward (clockwise) rotation of link 88 about end 92 causes edge 128 of link 88 to bear against the associated side 106 or 107 of bushing 102. The side of pin 110 bears against the side of hole 116 in second link 94, pulling link 94 upwards and forward (clockwise in FIG. 4) about its second end 98, which is pivotally attached to frame inside surface 28 forward of second end 92 of link 88. The force exerted on second link 94 by bushing 102 also causes its first end 96 to exert an upwardly directed force on bearing 70 to which it is pivotally attached, causing the front-most portion of intermediate member 62 to rise and move forward. The forward motion of member 62 causes bracket 68 to bear against rod 60, which is attached to chair back 42. The movement of rod 60 with bracket 68 causes back 42 to rotate counterclockwise (FIG. 4) about pivot points 40, 52 and back 42 correspondingly reclines. Note that as back 42 rotates counterclockwise arcuate slot 50 travels about brace 38 from its first end 118 toward its second end 120. As recliner chair 20 approaches the configuration shown in FIG. 5, striking surface 146 of lock plate 142 strikes the tip 154 of lock pin 152, sliding thereupon and depressing pin 152 into brace 36 against the force of spring 158. With further motion chair 20 assumes the configuration shown in FIG. 5, and lock pin 152, urged by spring 158, is received in recess 144 of plate 142. With lock 140 engaged, clockwise motion of back 42 about pivot points 40, 52 is prevented, thus locking chair 20 in its bed configuration. Further counter-clockwise motion of chair back 42 is prevented by brace 38 abutting second end 120 of slot 50. Moreover, further forward motion of intermediate member 62 and seat 72 is prevented by rod 60 bearing against bracket 68 and bushing 102 bearing against member 88, respectively.

To convert recliner chair 20 from its bed configuration to its chair configuration, first, lock pin 152 is pulled out of engagement with recess 144 and into brace 36 against the force of spring 158 by Bowden cable 162, actuated by lock release lever 164. With pin 152 retracted, an upward pull on back 42 initiates clockwise rotation of back 42 about pivot points 40, 52. After slight initial clockwise rotation of back 42, tip 154 of lock pin 152 is no longer disposed over recess 144 of lock plate 142 and lever 164 may be released, allowing pin tip 154 to slide along striking surface 146. Lifting back 42 to its fully upright position and subsequently moving the front-most portion of seat 72 rearward returns chair 20 to its original chair configuration.

While this invention has been described as having exemplary methods and designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A chair which is convertible into a reclining position, said chair comprising:

a seat;

a frame for supporting said seat;

a back connected to said frame;

a intermediate member connected to said seat; and a linkage interconnecting said seat, and said intermediate member, said linkage comprising first and second elongated links and a bushing, said first link having one end connected to said seat, said second link having one end connected to said intermediate member, said bushing rotatably connected to one said link and slideably connected to the other said ink.

2. The chair of claim 1, wherein said seat includes wheels.

3. The chair of claim 1, wherein said intermediate member is disposed between said back and said seat while said chair is in a bed configuration.

4. The chair of claim 1, wherein said intermediate member is disposed beneath said seat while said chair is in a chair configuration.

5. The chair of claim 1, further comprising:

a releasable lock to lock said chair in a bed configuration.

6. The chair of claim 1, wherein said first link of said linkage is slideably connected to said seat.

7. The chair of claim 1, wherein said back is pivotally connected to said frame.

8. The chair of claim 1, wherein said frame includes wheels.

9. A chair which is convertible into a bed, said chair comprising:

a seat having a lower surface, said surface including a slot;

a frame for supporting said seat;

a back connected to said frame;

an intermediate member connected to said seat; and a linkage interconnecting said seat and said intermediate member, said linkage comprising first and second elongated links and a bushing, said first link having one end slideably engaged in said slot, said second link having one end connected to said intermediate member, said bushing rotatably connected to one said link and slideably connected to the other said link.

10. The chair of claim 9, wherein said seat includes wheels.

11. The chair of claim 9, wherein said intermediate member is disposed between said back and said seat while said chair is in a bed configuration.

12. The chair of claim 9, wherein said intermediate member is disposed beneath said seat while said chair is in a chair configuration.

13. The chair of claim 9, further comprising:

a releasable lock by which said chair is locked in a bed configuration.

14. The chair of claim 9, wherein said back is pivotally connected to frame.

15. The chair of claim 9, wherein said frame includes wheels.

16. A chair which is convertible into a bed, said chair comprising:

a seat having a lower surface, said surface including a slot;

a frame for supporting said seat;

a back connected to said frame;

an intermediate member connected to said seat; and a linkage interconnecting said seat and said intermediate member, said linkage comprising first and second elongated links and a bushing, said first link having a first end slideably engaged in said slot of said seat and a second end pivotally attached to said frame, said second link having a first end connected to said intermediate member and a second end pivotally attached to said frame, said bushing rotatably connected to one said link and slideably connected to the other said link.

17. The chair of claim 16, wherein said seat includes wheels.

18. The chair of claim 16, wherein said intermediate member is disposed between said back and said seat while said chair is in a bed configuration.

19. The chair of claim 16, wherein said intermediate member is disposed beneath said seat while said chair is in a chair configuration.

20. The chair of claim 16, further comprising:

a releasable lock by which said chair is locked in a bed configuration.

21. The chair of claim 16, wherein said back is pivotally connected to frame.

22. The chair of claim 16, wherein said frame includes wheels.

* * * * *

UNITED STATES PATENT AND TRADEMARK OFFICE

CERTIFICATE OF CORRECTION

PATENT NO. : 5,904,401

DATED : May 18, 1999

INVENTOR(S) : Joel D. Alberda et al.

It is certified that error appears in the above-identified patent and that said Letters Patent is hereby corrected as shown below:

Claim 1, Col. 7, Line 47 delete "ink" and insert --link--.

Signed and Sealed this

Nineteenth Day of October, 1999

*Attest:*

*Attesting Officer*

Q. TODD DICKINSON

*Acting Commissioner of Patents and Trademarks*